US008926336B2

(12) United States Patent
Göbel et al.

(10) Patent No.: US 8,926,336 B2
(45) Date of Patent: Jan. 6, 2015

(54) ROTATABLE ELECTRICAL COUPLING DEVICE

(75) Inventors: Andreas Göbel, Eiterfeld (DE); Fritz Ickler, Kirchheim (DE)

(73) Assignee: Ondal Medical Systems GmbH, Hunfeld (DE)

( * ) Notice: Subject to any disclaimer, the term of this patent is extended or adjusted under 35 U.S.C. 154(b) by 0 days.

(21) Appl. No.: 13/701,809

(22) PCT Filed: Jun. 3, 2011

(86) PCT No.: PCT/EP2011/002750

§ 371 (c)(1), (2), (4) Date: Dec. 20, 2012

(87) PCT Pub. No.: WO2011/151081

PCT Pub. Date: Dec. 8, 2011

(65) Prior Publication Data

US 2013/0115784 A1 May 9, 2013

(30) Foreign Application Priority Data

Jun. 4, 2010 (EP) ..... 10005817

(51) Int. Cl.

| | |
|---|---|
| ***H01R 9/05*** | (2006.01) |
| ***H01R 24/40*** | (2011.01) |
| ***H01R 39/64*** | (2006.01) |
| ***H01R 24/54*** | (2011.01) |
| *H01R 13/6471* | (2011.01) |
| *H01R 103/00* | (2006.01) |
| *H01R 13/6592* | (2011.01) |
| *H01R 35/04* | (2006.01) |

(52) U.S. Cl.

CPC ..... *H01R 24/40* (2013.01); *H01R 39/64* (2013.01); *H01R 24/542* (2013.01); *H01R 13/6471* (2013.01); *H01R 2103/00* (2013.01); *H01R 13/6592* (2013.01); *H01R 35/04* (2013.01)

USPC ..... 439/13; 439/578

(58) Field of Classification Search

USPC ..... 439/13–30, 578

See application file for complete search history.

(56) References Cited

U.S. PATENT DOCUMENTS

| | | | |
|---|---|---|---|
| 2,645,759 | A | 7/1953 | Solari |
| 3,107,960 | A | 10/1963 | Neher et al. |

(Continued)

FOREIGN PATENT DOCUMENTS

| | | |
|---|---|---|
| CH | 197966 | 8/1938 |
| EP | 0 768 738 A1 | 4/1997 |

(Continued)

*Primary Examiner* — Gary Paumen

(74) *Attorney, Agent, or Firm* — Seed IP Law Group PLLC

(57) ABSTRACT

A rotatable electrical coupling device incorporates a first connector having a first electrical contact member adapted to conduct or transmit a high-frequency and/or high-speed data signal, and a second connector having a second electrical contact member adapted to conduct or transmit a high-frequency and/or high-speed data signal. The second connector is configured to be coupled with the first connector for substantially free or unimpeded rotation about an axis (X) relative to the first connector, the first and second electrical contact members being configured to engage one another and to maintain uninterrupted electrical contact throughout a relative rotational movement between the first and second connectors in a coupled state.

14 Claims, 2 Drawing Sheets

(56) References Cited

U.S. PATENT DOCUMENTS

| | | | | |
|---|---|---|---|---|
| 3,237,147 | A | 2/1966 | Elliott et al. | |
| 3,860,312 | A | 1/1975 | Gordon, Jr. | |
| 4,022,518 | A | 5/1977 | Gattaz | |
| 4,326,769 | A | 4/1982 | Dorsey et al. | |
| 5,700,160 | A * | 12/1997 | Lee | 439/578 |
| 6,409,550 | B1 | 6/2002 | Splichal et al. | |

FOREIGN PATENT DOCUMENTS

| | | | |
|---|---|---|---|
| FR | 2 702 097 | A1 | 9/1994 |
| JP | 2004-55246 | A | 2/2004 |
| WO | 99/49476 | A1 | 9/1999 |

* cited by examiner

ROTATABLE ELECTRICAL COUPLING DEVICE

TECHNICAL FIELD

The present invention relates to a rotatable electrical coupling device and, more particularly, to a coupling device configured to provide an uninterrupted electrical connection between coupled components throughout relative rotation thereof about a rotational axis of the device.

The rotatable electrical coupling of the invention is desirably designed for use in a swivel or pivot joint of a mounting arm, such as the type of mounting arm used for supporting or suspending technical equipment, e.g. in medical or in commercial or industrial environments. In this way, the rotatable coupling of the invention is able to provide reliable electrical communication through the joint of the mounting arm to the technical equipment, regardless of rotary movement of that joint. As such, it will be convenient to hereinafter describe the invention in this particular context. It will be noted, however, that the rotatable electrical coupling device of the invention is not limited to use in a swivel or pivot joint of a mounting arm.

BACKGROUND OF THE INVENTION

An electrical coupling device of the type to which the invention relates typically comprises two connector components which are configured to be coupled together to interconnect two or more transmission paths to provide electrical communication there-between. One connector component may be configured as a male or plug-type connector and the other connector component may be configured as a female or socket-type connector for receiving the male or plug-type connector.

An example of a rotatable electrical coupling device for use in a swivel or pivot joint of a mounting arm is described in International Patent Application Publication No. WO-03/092127 A1. It has been found, however, that such coupling designs are not always suitable to meet the requirements demanded of equipment mounting systems in modern healthcare, commercial and industrial applications. In particular, the technical equipment which is to be supported or suspended on such carrier arm systems often demand connection performance that is not provided by such prior art coupling arrangements.

SUMMARY OF THE INVENTION

Thus, the present invention has been developed to meet this need. In particular, the present invention provides a new and improved rotatable electrical coupling device for use in a swivel or pivot joint of an equipment mounting system.

According to one broad aspect, the present invention provides a rotatable electrical coupling device for high-frequency and/or high-speed data transmission, comprising: a first connector having a first electrical contact member adapted to conduct or transmit a high-frequency and/or high-speed data signal; and a second connector having a second electrical contact member adapted to conduct or transmit a high-frequency and/or high-speed data signal. The second connector is configured to be coupled with the first connector for preferably substantially free or unimpeded rotational movement relative to the first connector about an axis. The first and second electrical contact members are configured to engage with one another when the first and second connectors are in a coupled state and to maintain uninterrupted electrical communication throughout a relative rotational movement between the first and second connectors. The angular extent or range of the preferably substantially free or unimpeded relative rotational movement may be limited, but it is preferably through an angle of at least about 90°, more preferably an angle of at least about 180°, and most preferably an angle of at least about 360°.

In the context of the present invention, the reference to "high-frequency" data signals in this description will be generally understood as a reference to RF signals, and in particular, to RF signals having frequencies in the UHF range and higher, namely electromagnetic signals having a frequency of about 300 MHz and higher (the UHF band range generally deemed to extend to about 3 GHz), and preferably including SHF signals up to about 30 GHz, and more preferably including EHF signals up to about 300 GHz. Further, the reference to "high-speed" data signals in this description will be generally understood to refer to digital data transmission rates of about 100 kbit/s or more, and preferably includes transmission rates up to about 100 Mbit/s, and more preferably includes transmission rates up to about 100 Gbit/s, and even higher. In this way, the first and second electrical contact members which are adapted conduct or transmit a high-frequency and/or high-speed data signal may, for example, be adapted for high quality image transmission via UHF, digital video, and/or digital HDTV signals.

In a preferred form of the invention, the first connector may include a first casing that substantially surrounds and is spaced from the first contact member. Similarly, the second connector preferably includes a second casing that substantially surrounds and is spaced from the second electrical contact member. In a particularly preferred form of the invention, the second connector is configured to be received within the first casing for rotational movement relative to the first connector. As such, the relatively rotatable second connector may be inside the casing of the first connector. As a skilled person will appreciate from the description later, however, the invention also contemplates that the first connector may be configured to be received within the second casing; i.e. such that the first connector is inside the casing of the relatively rotatable second connector. Importantly, the second connector is adapted to be preferably freely rotatable relative to the first connector, i.e. in an preferably unimpeded fashion. As such, the first and second casings preferably make only minimal contact with one another in the coupled state. That is, they are preferably not configured to engage in an interference fit or a friction fit with one another. In this way, frictional resistance to free or unimpeded relative rotation between the first and second connectors can be held to a minimum.

In a preferred form of the invention, the first electrical contact member is formed as an electrically shielded contact member. To this end, the first casing is preferably electrically conductive and is configured to form an electrical shield around the first contact member. In this way, the first electrical contact member may form the inner or core conductor of a coaxial connector, e.g. designed for use with coaxial cable, and the first casing may form an outer or shield conductor spaced radially outwards from the inner or core conductor. The inner or core conductor is preferably fully screened or shielded along its length, and the two conductors (i.e. core and shield) are preferably separated by a layer or mantle of dielectric material, such as polyethylene (PE) or polytetrafluoroethylene (PTFE).

In a corresponding manner, the second electrical contact member may be formed as an electrically shielded contact member. Thus, the second casing may be electrically conductive and configured to form an electrical shield around the second contact member. Each of the first and second connectors is therefore preferably configured as a coaxial connector in a rotatable coaxial coupling device. The first and second casings are each desirably formed as a relatively thin-walled shell or sleeve, typically made of a suitable metal or other electrically conductive material. When operating as an outer or shield conductor in a coaxial connector, the respective casing will usually be electrically grounded.

According to another aspect, therefore, the invention provides a rotatable electrical coupling device comprising a first coaxial connector having a first core conductor or contact member being adapted to conduct or transmit a high-frequency and/or high-speed data signal, and a second coaxial connector having a second core conductor or contact member being adapted to conduct or transmit a high-frequency and/or high-speed data signal. The second coaxial connector is configured to be coupled with the first coaxial connector to be substantially freely rotatable relative to the first connector about an axis, whereby the first and second core conductors or contact members are configured to engage one another and to maintain uninterrupted electrical contact throughout a relative rotational movement between the first and second coaxial connectors in a coupled state.

By carefully selecting the geometry, material and dimensions of the conductors and the layer or mantle of dielectric material, the first and second coaxial connectors can be designed to have a specific characteristic impedance for high signal transmission performance with minimised reflection. For example, the characteristic impedance may be designed to be 30 Ohm, 50 Ohm or 75 Ohm, and is preferably designed to be within the range of 30 to 200 Ohm. Furthermore, by forming the first and second coaxial connectors fully shielded, little or no interference and little or no sensitivity to interference arises in transmission of the high-frequency and/or high-speed data signal via this coupling device.

In view of the above comments, it will be appreciated that in a preferred form of the invention the first electrical contact member is arranged substantially centrally of the first connector and may extend along the rotational axis of the coupling device. Similarly, the second electrical contact member is preferably arranged substantially centrally of the second connector and may extend along the rotational axis of the coupling device. The first and second electrical contact members may therefore be configured to engage one another in the axial direction to establish an electrical connection there-between, e.g. on the rotational axis of the coupling device. That is, in a particularly preferred form of the invention, the first electrical contact member is configured to engage and/or connect with the second contact member in the axial direction to establish an electrical connection there-between. The engagement or connection is preferably effected via an axial mating of opposed end regions of the respective contact members; e.g. in surface-to-surface contact.

In a preferred form of the invention, a part of the first contact member configured to engage with the second contact member comprises one of a male element and a female element, and a complementary part of the second contact member which is configured to engage with said part of the first contact member comprises the other of a male element and a female element. These respective parts of the first and second contact members are thus adapted for mating engagement and are preferably rotationally symmetrical about the rotational axis of the device for continuous surface contact with one another. For example, the part comprising the male element may consist of a protrusion element, such as a cylindrical or tapered pin preferably having a rounded end. The part comprising the female element, on the other hand, may be a socket element with a recess or cavity having a geometry complementary to the pin.

In a preferred form of the invention, the first and second electrical contact members are biased to engage one another and to maintain uninterrupted electrical contact throughout a relative rotational movement between the first and second connectors. To this end, the rotatable electrical coupling device of the invention preferably includes at least one biasing member which is provided on the first connector or on the second connector and which is arranged to bias either the first contact member or the second contact member into engagement with the other when the first and second connectors are in the coupled state. The biasing member may be resiliently yieldable and preferably acts to bias one of the first and second electrical contact members in the axial direction towards the other. For example, the one or more biasing member may be provided on the first connector for contact or engagement with the second casing. Alternatively, or in addition, at least one biasing member may be provided on the second connector for contact or engagement with the first casing. In a particularly preferred arrangement, the at least one biasing member is arranged between the first casing and the second casing.

In a preferred form of the invention, the coupling device includes at least one further (i.e. third) electrical contact member to provide an electrical connection between the first casing and the second casing. Thus, the third contact member operates to ensure that both of the first and second casings, which preferably serve as outer or shield conductors around inner or core conductors formed by the first and second electrical contact members respectively, remain grounded. In a highly preferred embodiment of the invention, the at least one biasing member is electrically conductive and thus forms the further (third) electrical contact member providing an electrical connection between the first casing and the second casing. Preferably, a plurality of biasing members (i.e. third contact members) is provided. Each biasing member (or third electrical contact member) may comprise, or be formed as, a spring element (e.g. a leaf-spring) and desirably presents a very small contact area for contacting the respective first or second casing. By providing a reduced contact area in this way, it is possible to minimise frictional interference during the relative rotation of the first and second connectors.

In a preferred form of the invention, the rotatable electrical coupling device further comprises a retaining member configured to secure or lock the second connector against removal from the coupled state with the first connector. For example, when the second connector is received within the first casing in the coupled state, the retaining member may be configured to secure or lock the second connector within the first casing. The retaining member is thus designed to prevent any inadvertent or unwanted removal of the second connector from the first connector, but without inhibiting the relative rotational movement of the first and second connectors. In this way, an inadvertent or unwanted disconnection of the coupling device can thus be avoided. The retaining member may, for example, be provided on, or as part of, the first casing to hold the second connector against removal from the first casing. In this regard, the retaining member may be formed as a cover or closure at an end of the first casing for substantially enclosing the second connector within the first casing. In an alternative embodiment, the first connector may be configured to be received by or within the second connector in the coupled state. As such, the retaining member may be configured to secure the first connector within the second casing, i.e. against inadvertent or unwanted removal of the first connector from the second connector. Thus, the retaining member is desirably configured to provide a releasable, axially capturing or secure attachment or coupling of the first and second connectors. In a highly preferred embodiment of the invention, the at least one biasing member is provided on the retaining member (e.g. inside a cover or closure at an end of the first casing) for contact or engagement with an outer surface of the second casing.

In a preferred form of the invention, the coupling device includes mounting means for mounting the coupling device to a frame or structure of a support system, e.g. in a swivel or pivot joint of an equipment support system. The mounting means may, for example, comprise a mounting member, such as a bracket or flange, for attaching the coupling device via fastening elements, such as one or more bolts or screws, to the supporting frame or structure. In one particular embodiment of the invention, the mounting member is provided on, or forms part of, the first connector. For example, the mounting member may be formed as part of the first casing. Indeed, where the retaining member forms a cover or closure at an end of the first casing, the mounting member may desirably form a part of, or an extension of, the retaining member. That is, the retaining member may include a laterally extending flange or bracket member provided integral therewith for fixing the coupling device in position on the support frame or structure.

In a preferred form of the invention, the first connector includes a first adapter for releasably connecting a cable designed for high-frequency and/or high-speed data transmission. The first adapter includes at least a first connection point at which a cable conductor can be electrically connected with the first contact member of the coupling device. As such, the first connection point is in electrical communication with the first contact member. In one embodiment, for example, the first connection point may include jaw elements which are provided at an end of the first contact member and are configured to receive and grip an electrical conductor of the cable between them. The jaw elements are desirably resiliently biased to grip or hold the electrical conductor of the cable there-between. In an alternative embodiment, the first connection point includes a stud or pin at an end of the first contact member which is configured to be received or gripped within a conventional cable jack or socket. In this regard, the first adapter is preferably configured for connection with a conventional cable jack or socket-type connector. In the event the rotatable coupling device of the invention is embodied with coaxial connectors, the adapter is therefore designed for releasably connecting a conventional coaxial cable jack or socket, such as a BNC- or C-connector, or an F-connector. The first adapter may thus include a further connection point at which an outer shield conductor of the coaxial cable can be electrically connected with the first casing of the coupling device. That further connection point should therefore, of course, be in electrical communication with the first casing and may be designed for a press-fit, a bayonet, or a threaded or screwed connection with the coaxial cable jack or socket.

In a similar fashion, the second connector preferably includes a second adapter for releasably connecting a cable designed for high-frequency and/or high-speed data transmission. As such, the second adapter includes a second connection point at which a cable conductor can be electrically connected with the second contact member of the coupling device. Preferably, the design and operation of the second adapter corresponds to the design and operation of the first adapter. Again, therefore, the second adapter is typically configured for attachment of a conventional coaxial cable jack or socket-type connector, such as a BNC-, C-, or F-connector.

In view of the fact that the second connector is desirably designed to be received by and/or within the first connector, the second connector may be notionally deemed to be a male or plug-type connector, and the first connector may be notionally deemed to be a female or socket-type connector for receiving the male connector. As noted above, the mating parts of the first and second electrical contact members may be provided with male (plug-type) and female (socket-type) elements for engagement with one another.

In a preferred form of the invention, each of the first and second electrical contact members adapted to conduct or transmit a high-frequency and/or a high-speed data signal is substantially fully insulated from its respective casing. That is, the first and second electrical contact members are preferably substantially encased within or surrounded by a sheath or mantle of dielectric (i.e. electrically insulating) material, such as a polymer material like polyethylene (PE) or polytetrafluoroethylene (PTFE).

In a preferred form of the invention, each of the first and second electrical contact members for conducting or transmitting a high-frequency data and/or high-speed data signal is configured to be at least partially rotationally symmetrical about the rotational axis of the coupling—i.e. at least in the region where the first and second electrical contact members come into engagement or contact with one another. That is, the first and second electrical contact members are at least partially, and desirably substantially fully, rotationally symmetrical about a central or longitudinal axis of the electrical coupling.

In another preferred form of the invention, each of the first and second electrical contact members comprises a waveguide, such as an optical waveguide, adapted to conduct or transmit electromagnetic waves in the optical spectrum (i.e. light). In other words, the high-frequency and/or a high-speed data signals may be transmitted as light via an optical waveguide. In this context, one of the most common examples for such a waveguide is one or more optical fibre, particularly optical glass fibres.

In a preferred form of the invention, at least one region of the second casing located adjacent the first casing in the coupled state is configured to reduce or minimise the frictional resistance during relative rotation of the second connector. The at least one region may, for example, comprise one or more abutting surface or journal surface for contact with the first casing. In this regard, each said abutting or journal surface preferably presents a small surface area, e.g. in the form of a narrow band or strip. Further, the at least one region of the second casing may be formed from or coated with a material having low friction properties. In an alternative embodiment, at least one region of the first casing located adjacent the second casing in the coupled state is configured to reduce or minimise frictional resistance during relative rotation of the second connector.

In a preferred form of the invention, the electrical contact members are formed from a material selected from the group consisting of: copper, silver, gold, alloys of any one of copper, silver, and gold, and any combination of same, including plating. The materials may thus also include alloys such as bronze and brass.

Thus, the invention provides an electrical coupling device specifically designed to provide for the transfer or transmission of high-frequency data signals and/or high-speed data signals, such as UHF, digital video, and digital HDTV signals, while still permitting rotation of the coupling through at least about 180°, preferably through at least about 360°, and more preferably with unlimited or full rotational flexibility permitting repeated rotation. Thus, the electrical coupling of the invention is able to provide for reliable transmission of high-frequency and/or high-speed data signals to and/or from one or more items of technical equipment mounted on an end of an articulated, rotatable support arm, with the coupling device and cables incorporated within the support arm.

According to another aspect, the present invention provides a swivel or pivot joint of a mounting arm for supporting or suspending technical equipment, wherein the joint incorporates an electrical coupling device of the invention as described above. As noted at the outset, however, the electrical coupling device of the invention is not limited to use in a swivel or pivot joint of a mounting arm but may find application in a broad range of fields.

BRIEF DESCRIPTION OF THE DRAWINGS

The above and further features and advantages of the invention will become more readily apparent from the following detailed description of preferred embodiments of the invention with reference to the accompanying drawings, in which like reference characters identify like features, and in which.

DETAILED DESCRIPTION OF THE PREFERRED EMBODIMENTS

Figures 1, 2, 3:
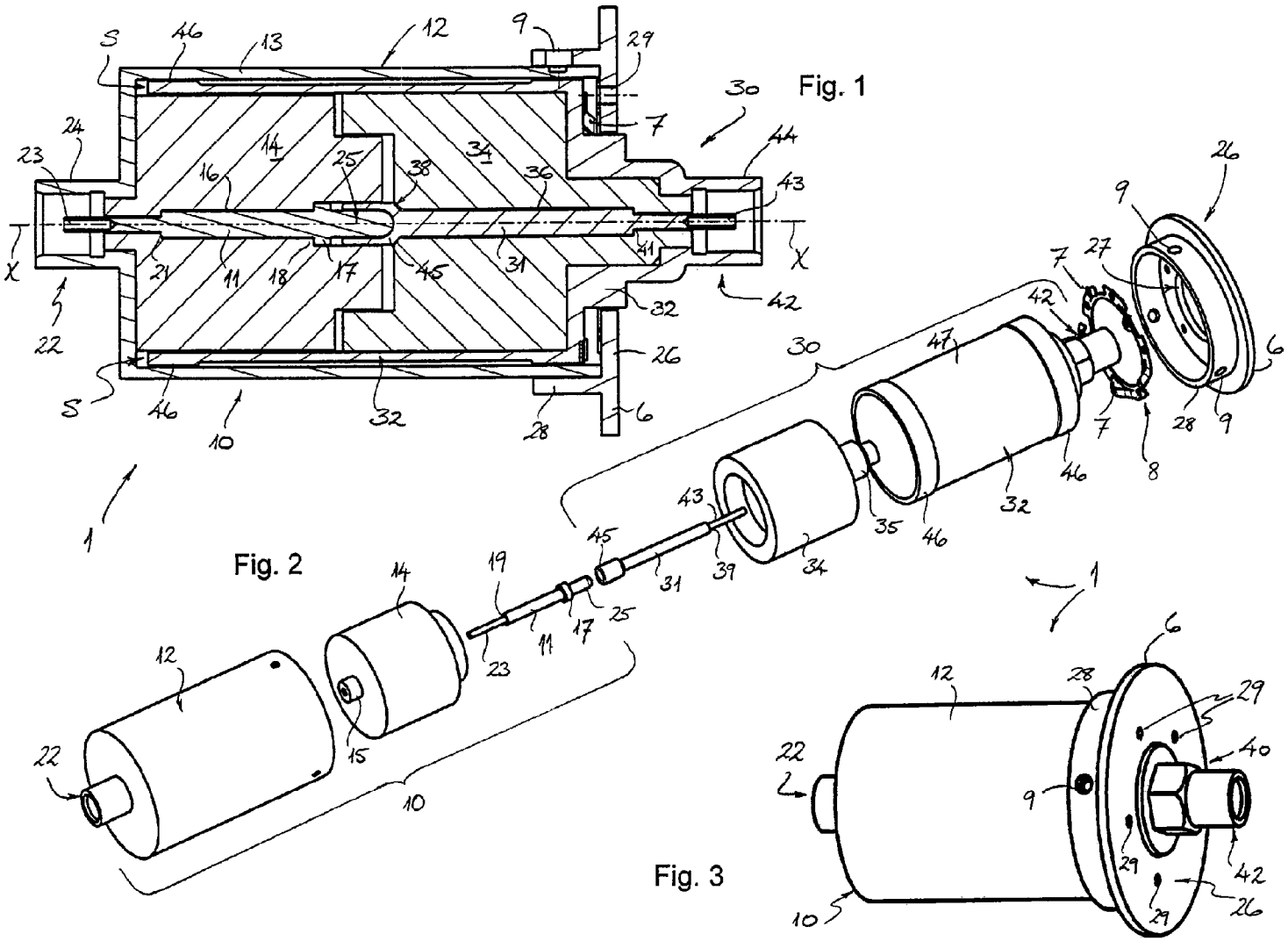
FIG. 1 is a cross-sectional view of a rotatable electrical coupling device according to a preferred embodiment of the invention in a coupled state.
FIG. 2 is an exploded perspective view of the components of the rotatable electrical coupling device of FIG. 1.
FIG. 3 is a perspective view of the coupling device of FIG. 1.

With reference firstly to FIGS. 1 to 3 of the drawings, a rotatable electrical coupling device 1 for a high-frequency and/or high-speed data transmission according to a preferred embodiment of the invention is illustrated. The electrical coupling device 1 has a first connector 10 and a second connector 30, which are shown in FIG. 1 and FIG. 3 of the drawings in a combined or coupled state in rotatable engagement with one another. The exploded view of the coupling device 1 in FIG. 2 more clearly illustrates the various components of each of the first and second connectors 10, 30.

With particular reference to FIGS. 1 and 2, therefore, the first connector 10 of the coupling device 1 can be seen to include a first electrical contact member 11 which is generally elongate and formed as a rod- or pin-like member. This rod- or pin-like first contact member 11 has a generally circular cross-section and extends centrally of the first connector 10. Furthermore, the first contact member 11 is surrounded by and substantially housed within a first casing 12, which forms a shell or sleeve with a generally cylindrical wall 13 that is radially spaced from and extends around the first contact member 11. In this embodiment, the first connector 10 is formed as a coaxial connector, such that the first electrical contact member 11 is configured to operate as an inner or core conductor and the surrounding first casing 12 forms an outer shield conductor for shielding the central rod- or pin-like member 11 from any external interference. As such, the first contact member 11 is adapted to conduct or transmit a high frequency and/or high-speed data signal, such as a HDTV signal.

As can also be seen in FIGS. 1 and 2, the first connector 10 includes a first insulating body 14 of dielectric material which forms a layer or mantle around the first contact member or core conductor 11 for both spatially and electrically isolating that conductor from the first casing 12. Thus, the body 14 may serve to position the first contact member 11 relative to the casing 12 within the first connector 10. In this regard, the body 14 includes a short projection or stub 15 provided centrally at an end thereof for receipt in a corresponding recess formed at an end of the first casing 12 to locate the first insulating body 14 centred within the first connector 10. In addition, the body 14 includes a central bore 16 which is configured to receive and hold the rod- or pin-shaped first contact member 11 therein. In this respect, the geometry and the dimensions of the bore 16 are preferably such that the first contact member 11 is received and snugly held in an interference fit within the bore 16. The rod or pin member 11 has a small radial flange or collar 17 which is designed to abut a corresponding annular seat 18 within the bore 16 towards a distal or free end of the contact member. Further, the rod or pin contact member 11 also has a radially inwardly stepped shoulder 19 closer to a proximal end which abuts a corresponding seat 21 in the bore 16. As such, the rod- or pin-like first contact member 11 is not able to be inadvertently shifted or pushed out of its proper position along the central axis of the first connector 10. Rather, it is held fixed by the first insulating body 14, which itself is centred and held precisely positioned within the first casing 12. As noted earlier, by carefully selecting the material and geometry of the inner and outer conductors 11, 12 and the body or mantle 14 of dielectric material, a specific characteristic impedance can be provided for the first coaxial connector 10.

With continued reference to FIGS. 1 and 2, it will be noted that the first connector 10 also includes a first adapter 22 provided at the proximal end region 20 thereof for releasably connecting a coaxial cable (not shown) to the first connector 10. The adapter 22 comprises a first connection point 23 that is configured to connect a core or central conductor of the coaxial cable (not shown) in electrical communication with the first contact member 11. In this regard, the first adapter 14 is generally configured to cooperate and connect with a conventional coaxial cable jack or socket, such as a BCN-, C-, or F-connector. To this end, the first connection point 23 is desirably formed integral with the first contact member 11 at the proximal end thereof and is provided as either a pin element or a hollow shaft element designed to engage in a friction fit with a corresponding element (e.g. a complementary hollow shaft or pin element, respectively) of a conventional coaxial cable jack or socket, as known in the art. The first adapter 21 thus includes a further connection point 24 in the form of a generally cylindrical collar surrounding the first connecting point 23 and configured for connection with a complementary collar of a conventional cable jack or socket in electrical communication with the outer or shield conductor of the coaxial cable. To this end, the further connection point 24 may be formed integral with the first casing 12 and is configured to connect with the cable jack or socket via, for example, an interference or press-fit, a bayonet connection, or alternatively by a threaded or screw connection as it is known in the art.

The second connector 30 of the coupling device 1 has features that closely resemble or correspond to the features of the first connector 10 described above. In particular, the second connector 30 comprises a second electrical contact member 31 adapted to conduct or transmit a high frequency and/or high-speed data signal. The second contact member 31 is generally elongate and is formed as a rod- or pin-like member extending centrally of the second connector 30 and having a circular cross-section. Further, the second contact member 31 is surrounded by and substantially housed within a second casing 32. Again, the second casing 32 forms a shell or sleeve with a generally cylindrical wall 33 that is radially spaced from and extends around the second contact member 31. The second connector 30 is of course also formed as a coaxial connector, such that the second contact member 31 is configured to operate as an inner or core conductor and the surrounding second casing 32 is electrically conductive and forms an outer shield conductor for shielding the signal conducted by the central rod- or pin-like member 31 from external effects or interference.

Like the first connector 10, the second connector 30 also includes an insulating body 34 of dielectric material which forms a layer or mantle around the second contact member 31 for both spatially and electrically isolating that core conductor from the second casing 32. As such, the second insulating body 34 also serves to position the second contact member 31 relative to the casing 32 within the second connector 30. The body 34 again has a short projection or stub 35 provided centrally at an end thereof for receipt in a corresponding recess formed at an end of the second casing 32 to locate the second insulating body 34 centred within the second connector 30. In addition, the body 34 includes a central bore 36 which is configured to receive and snugly hold the rod- or pin-like second contact member 31 in an interference fit. The head region 37 of the rod or pin member 31 is enlarged and designed to abut a corresponding seat 38 at a distal end of the contact member. Further, the rod or pin member 11 has a radially inwardly stepped shoulder 39 closer to the opposite end which also abuts a corresponding seat 41 in the bore 36. Again, therefore, the rod- or pin-like second contact member 31 is not able to be inadvertently shifted or pushed out of its proper position along the central axis of the second connector 30. Rather, it is held fixed by the second insulating body 34, which itself is centred and precisely fixed within the second casing 32.

The second connector 30 also includes a second adapter 42 at the proximal end region 40 thereof for releasably connecting a coaxial cable (not shown). The second adapter 42 comprises a second connection point 43 configured to connect a core or central conductor of the coaxial cable (not shown) in electrical communication with the second contact member 31. As such, the second adapter 42 is again configured to cooperate and connect with a conventional coaxial cable jack or socket, such as a C- or F-connector. The second connection point 43 is typically formed integral with the second contact member 31 at the proximal end thereof and is provided as either a pin element or a hollow shaft element which is designed to engage in a friction fit with a complementary element (e.g. a hollow shaft or a pin element, respectively) of a coaxial cable jack or socket, as is known in the art. Thus, the second adapter 42 also includes a further connection point 44 in the form of a generally cylindrical collar surrounding the second connecting point 43 and configured for connection with a complementary collar of a conventional cable jack or socket in electrical communication with the outer or shield conductor of the coaxial cable. The further connection point 44 is formed integral with the second casing 32 and is configured to connect with the cable jack or socket via, for example, an interference or press fit, a bayonet connection, or alternatively by a threaded or screw connection.

With reference to FIGS. 1 to 3 of the drawings, the interrelationship and interaction between the first and second connectors 10, 30 can be more fully appreciated when the two connectors are in the coupled state. In this particular embodiment, it will be seen that the first casing 12 of the first connector 10 is configured to receive and substantially house the second connector 30. In other words, the second connector 30 is configured to be inserted into the first casing 12. As such, the outer diameter of the second connector 30, and in particular of the second casing 32, is somewhat smaller than the inner diameter of the first casing 12. Furthermore, the diameter of the first body or mantle 14 of dielectric material is selected so as to leave an annular space S between it and the cylindrical wall or sleeve 13 of the first casing 12, and the free or distal end region of the second casing 32 is received within that space S.

When the second connector 30 is inserted into the first connector 10, the elongate rod or pin members forming the first and second contact members 11, 31 are aligned on a central axis X of the coupling device 1 and are configured to engage with one another in the axial direction. In this regard, the distal end of the first contact member 11 beyond the flange or collar 17 terminates in a male element 25 formed by a cylindrical shaft or stud having a rounded or spherical tip. As clearly apparent from FIG. 1, this male element 25 is configured for mating engagement with a complementary female element 45 at an end of the second contact member 31. In this embodiment, the female element 45 is formed with a generally cylindrical or cup-shaped recess or cavity having a rounded or spherical base for receiving the male element 25 precisely and making surface contact therewith. Importantly, the mating elements 25, 45 at the respective ends of the first and second electrical contact members 11, 31 have surfaces which are rotationally symmetrical about the central axis X to provide regular and reliable contact between these core conductors throughout the relative rotational movement between the first connector 10 and the second connector 30, as will now be described.

As can be seen in FIGS. 1 and 2 of the drawings, the second casing 31 includes two circumferential regions 46 having a slightly larger outer diameter at the proximal and distal ends of the casing 32 compared to an intervening portion 47. By appropriately selecting the dimensions (i.e. the width and diameter) of these regions 46, this design ensures that two operational properties of the coupling device 1 are obtained. Firstly, the second connector 30 can be received and positioned within the casing 11 of the first connector 10 with very little 'play' (i.e. freely, but snugly), which in turn ensures a precise axial alignment of the first and second contact members 11, 31. Secondly, by keeping the width of these regions 46 narrow, a surface interaction between an inner side of the first casing 12 and an outer surface of the second casing 32 can be minimized to reduce frictional interference between the two casings. Because the second connector 30 is configured to be rotatable within the first casing 12 about the central axis X relative to the first connector 10, the regions 46 of larger diameter thus present a small surface area so that the second casing 32 is free to rotate relative to the first casing 11 in a preferably substantially unimpeded manner, i.e. without notable friction between the facing surfaces, while still ensuring precise positioning. "In a substantially unimpeded manner" or "without notable friction" indicates that the electric coupling device of the present invention allows in this respect for a configuration with very low friction torque values including 0 Nm. While the friction torque may in principle also take high values, lower values are preferred. The friction torque may for example be about 10 Nm or less, preferably about 9.5 Nm or less, even more preferably about 9.0 Nm or less, even more preferably about 8.5 Nm or less, even more preferably about 8.0 Nm or less, even more preferably about 7.5 Nm or less, even more preferably about 7 Nm or less, even more preferably about 6.5 Nm or less, even more preferably about 6 Nm or less, even more preferably about 5.5 Nm or less, even more preferably about 5 Nm or less, even more preferably about 4.5 Nm or less, even more preferably about 4 Nm or less, even more preferably about 3.5 Nm or less, even more preferably about 3 Nm or less, even more preferably about 2.5 Nm or less, even more preferably about 2 Nm or less, even more preferably about 1.5 Nm or less, even more preferably about 1 Nm or less, even more preferably about 0.9 Nm or less, even more preferably about 0.8 Nm or less, even more preferably about 0.7 Nm or less, even more preferably about 0.6 Nm or less, even more preferably about 0.5 Nm or less, even more preferably about 0.4 Nm or less, even more preferably about 0.3 Nm or less, even more preferably about 0.2 Nm or less, even more preferably about 0.1 Nm or less, even more preferably about 0.075 Nm or less, even more preferably about 0.05 Nm or less, even more preferably about 0.04 Nm or less, even more preferably about 0.03 Nm or less, even more preferably about 0.02 Nm or less, even more preferably about 0.01 Nm or less, even more preferably about 0.0075 Nm or less, even more preferably about 0.005 Nm or less, even more preferably about 0.004 Nm or less, even more preferably about 0.003 Nm or less, even more preferably about 0.002 Nm or less, even more preferably about 0.001 Nm or less, even more preferably about 0.00075 Nm or less, even more preferably about 0.0005 Nm or less, even more preferably about 0.0004 Nm or less, even more preferably about 0.0003 Nm or less, even more preferably about 0.0002 Nm or less, even more preferably about 0.0001 Nm or less etc. The outer surface in these circumferential regions 46 may be fabricated or treated to have low-friction properties to ensure preferably unimpeded rotation of the second connector 30 relative to the first connector 10. Thus, when the first and second connectors 10, 30 are in the coupled state shown in FIG. 1, the second connector 30 is freely rotatable relative to the first connector 10 about the central or longitudinal axis X, and the first and second contact members 11, 31 are adapted to maintain uninterrupted electrical contact throughout the relative rotation.

With further reference to FIGS. 1 to 3 of the drawings, it will be seen that the first connector 10 also includes a retaining member 26 in the form of a cover or closure provided at an end of the first casing 12 to secure or hold the second connector 30 against removal from the coupled state with the first connector 10. In particular, the retaining member 26 comprises a plate or disk with a central opening 27 which may be placed over the second adapter 42 at the proximal end of the second connector 30, and a short collar 28 which is configured to be fastened to a distal end region of the first casing 12. In this respect, the collar 28 preferably incorporates three holes 9 which are arranged to align with correspondingly spaced holes in the first casing 12 for receiving appropriate fasteners (e.g. screws) for rigidly fixing the end cover 26 in position.

Furthermore, the coupling device 1 includes a ring-shaped component 8 arranged at an inner face of the plate or disk-shaped cover 26, to which it is preferably secured (e.g. with screws or other fasteners) via corresponding holes 29 provided in the cover member. The ring-shaped component 8 has a plurality of resilient strip members 7 that are spaced apart at substantially regular intervals around the ring component 8 and project out of the plane of the plate or disk-shaped cover 26 for engagement with an end face of the second casing 32. The plurality of strip members 7 have resilient or spring-like properties and are configured to bias the second connector 30 in the axial direction into the first casing 11 so that the second contact member 31 is biased into axial engagement with the first contact member 11. By providing the resilient strip members 7 spaced apart at regular intervals around the periphery of the ring component 8, the biasing action can be distributed symmetrically around the axis X. The ring component 8 and the plurality of resilient members 7 are formed from an electrically conductive material to ensure that electrical contact is provided between the first casing 12 and the second casing 32. Thus, these strip members 7 respectively form a plurality of third electrical contact members.

As is also clearly visible in each of FIGS. 1 to 3, the end cover member 26 includes a radially outwardly projecting rim or flange 6 for mounting the coupling device 1 to a support structure (not shown) of an apparatus in which the device 1 is employed. As noted at the outset, for example, the coupling device of the invention is particularly suitable for use in swivel or pivot joints of equipment mounting systems. As such, the rim or flange 6 is desirably provided to rigidly mount or secure the coupling device 1 within such a swivel or pivot joint. For example, the rim or flange 6 may be fixed via fasteners (e.g. screws or bolts) fitted through complementary holes formed through the flange or by a suitable clip or clamping arrangement. As will be appreciated, the fixation of the coupling device 1 via the rim or flange 6 fixes the first connector 10 via the first casing 12 and the cover member 26 relative to the support structure. The second connector 30, on the other hand, remains free to rotate relative to the first connector 10 within the first casing 12. Thus, the electrical coupling device 1 of the invention is particularly suitable for a swivel or pivot joint in which the pivoting or swivelling action occurs about the axis X of the coupling device. In other words, the coupling device 1 is designed to be incorporated in the joint such that the central axis X of the coupling device 1 is collinear or in alignment with the pivot or swivel axis of the joint.

Figure 4:
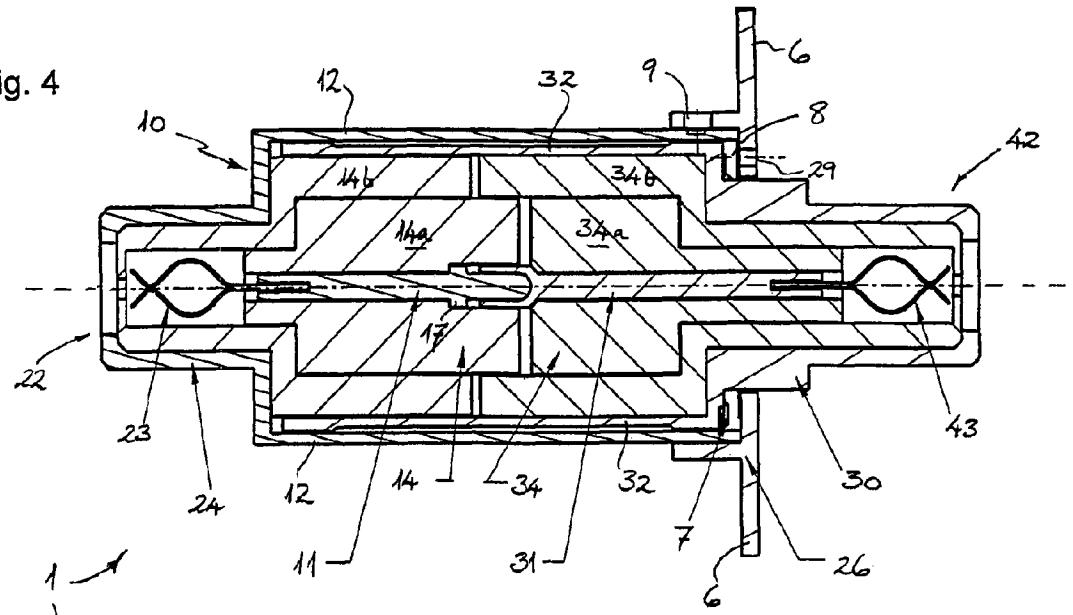
FIG. 4 is a cross-sectional view of a rotatable electrical coupling device according to another preferred embodiment of the invention in a coupled state.
Figure 6:
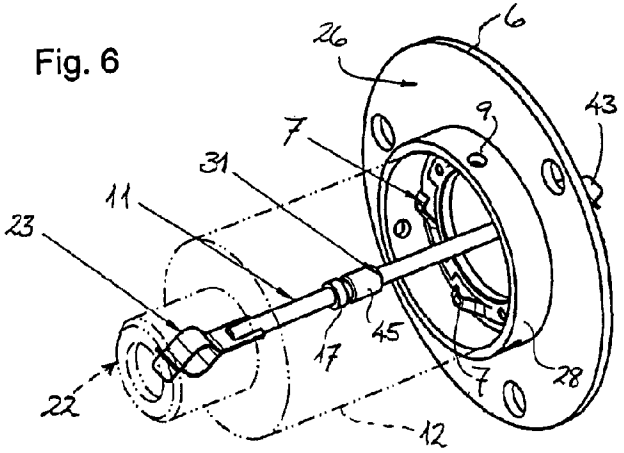
FIG. 6 is a perspective view of the coupling device of FIG. 4, with part of the coupling device removed (i.e. not shown) and part shown only in broken lines.
Figure 5:
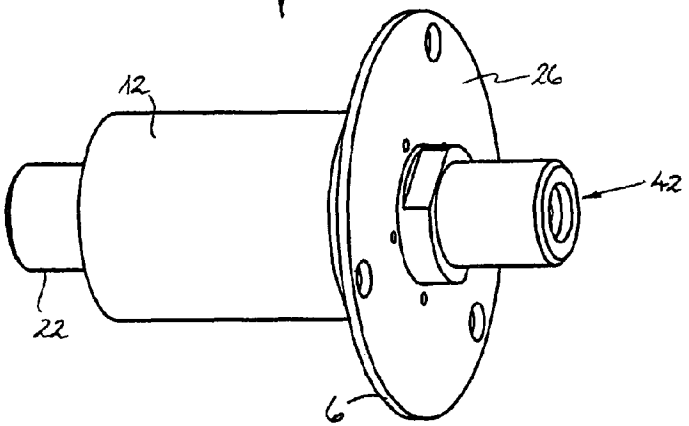
FIG. 5 is a perspective view of the coupling device of FIG. 4.

With reference now to FIGS. 4 to 6 of the drawings, another embodiment of the coupling device 1 of the invention is illustrated. This embodiment is very similar to the embodiment in FIGS. 1 to 3 and like drawing reference characters have been used throughout the various views to identify corresponding features. For simplicity, therefore, and to avoid repetition, the following description of the embodiment in FIGS. 4 to 6 will focus primarily on those features which differ somewhat from their counterparts in the embodiment of FIGS. 1 to 3.

One difference which is readily apparent relates to the first and second connection points 23, 43 of the first and second connecters 10, 30, respectively. Instead of being formed as a pin or hollow shaft-like element, each of the first and second connection points 23, 43 comprises a pair of jaw elements provided at an end of the respective first and second contact members 11, 31. Each pair of jaw elements 23, 43 is biased (i.e. resiliently) to receive and grip the central or core conductor between them when a conventional coaxial cable jack (not shown) is attached to the respective first and second adapter 22, 42. Because the jaw elements 23, 43 themselves are also formed from an electrically conductive material, the first and second contact members 11, 31 are thereby respectively connected in electrical communication with the central or core conductors of the coaxial cables (not shown).

A further difference in this embodiment resides in the respective body or mantle 14, 34 of dielectric material provided around each of the first and second electrical contact members 11, 31 of the first and second connectors 10, 30. In particular, each of the first and second insulating bodies 14, 34 in this embodiment has a two-part structure. The first body 14, for example, comprises an inner part 14*a* having the central bore 16 for receiving and holding the first contact member 11, and an outer part 14*b* which sheathes the inner part 14*a*. Similarly, the second body 34 also has a two-part structure comprising an inner part 34*a* having the bore 36 for receiving and holding the second contact member 31 and an outer part 34*b* which surrounds and sheathes the inner part 34*a*.

In FIG. 6 of the drawings, in which the second casing 32 and the second insulating body 34 are omitted and the first casing 12 is only alluded to by a broken outline, the retaining or cover member 26 and the ring component 8 with the resilient strip biasing members 7 can be seen particularly clearly. Each of the resilient strip biasing members 7 is angled out of the plane of the cover member 26 for engagement with an end face of the second casing 32 received within the first casing 12, and each is bent or curved for line contact with that end face (e.g. at a tangent) or over a very small area. In this way, the contact area of each of the resilient strip members 7 for potentially creating frictional interference during rotation of the second connector 30 relative to the first connecter 10 is maintained very small. It will also be appreciated that the spring force or biasing force exerted by the resilient members 7 is relatively small, thereby producing only a light positive contact, and thus only giving rise to very low frictional interference.

A person skilled in the art will understand that a technical advantage according to the present invention is that signal transmission is ensured over a wide range of friction, e.g. the parameterisation of friction may be variably adjusted via for example resilient strip members 7. As mentioned above, the friction torque may be in the range from 0 Nm or virtually 0 Nm up to very high values. However, lower values are preferred. The friction torque may for example be The friction torque may for example be about 10 Nm or less, preferably about 9.5 Nm or less, even more preferably about 9.0 Nm or less, even more preferably about 8.5 Nm or less, even more preferably about 8.0 Nm or less, even more preferably about 7.5 Nm or less, even more preferably about 7 Nm or less, even more preferably about 6.5 Nm or less, even more preferably about 6 Nm or less, even more preferably about 5.5 Nm or less, even more preferably about 5 Nm or less, even more preferably about 4.5 Nm or less, even more preferably about 4 Nm or less, even more preferably about 3.5 Nm or less, even more preferably about 3 Nm or less, even more preferably about 2.5 Nm or less, even more preferably about 2 Nm or less, even more preferably about 1.5 Nm or less, even more preferably about 1 Nm or less, even more preferably about 0.9 Nm or less, even more preferably about 0.8 Nm or less, even more preferably about 0.7 Nm or less, even more preferably about 0.6 Nm or less, even more preferably about 0.5 Nm or less, even more preferably about 0.4 Nm or less, even more preferably about 0.3 Nm or less, even more preferably about 0.2 Nm or less, even more preferably about 0.1 Nm or less, even more preferably about 0.075 Nm or less, even more preferably about 0.05 Nm or less, even more preferably about 0.04 Nm or less, even more preferably about 0.03 Nm or less, even more preferably about 0.02 Nm or less, even more preferably about 0.01 Nm or less, even more preferably about 0.0075 Nm or less, even more preferably about 0.005 Nm or less, even more preferably about 0.004 Nm or less, even more preferably about 0.003 Nm or less, even more preferably about 0.002 Nm or less, even more preferably about 0.001 Nm or less, even more preferably about 0.00075 Nm or less, even more preferably about 0.0005 Nm or less, even more preferably about 0.0004 Nm or less, even more preferably about 0.0003 Nm or less, even more preferably about 0.0002 Nm or less, even more preferably about 0.0001 Nm or less etc.

It will be appreciated that the above description of the preferred embodiments of the invention with reference to the drawings has been made by way of example only. A person skilled in the art will therefore appreciate that various changes, modifications or additions may be made to the parts particularly described and illustrated herein without departing from the scope of the invention as defined in the claims. A skilled person will, for example, appreciate that the first connector may be configured to be received by or within the second connector such that the outer connector is adapted to rotate relative to the inner connector.

The invention claimed is:

1. A rotatable electrical coupling device comprising:

a first connector having a first electrical contact member adapted to conduct or transmit a high-frequency and/or high-speed data signal;

a second connector having a second electrical contact member adapted to conduct or transmit a high-frequency and/or high-speed data signal; and at least one biasing member which acts to bias either the first contact member into engagement with the second contact member and/or the second contact member into engagement with the first contact member when the first and second connectors are in a coupled state;

wherein the first and second electrical contact members are configured to engage one another and to maintain uninterrupted electrical contact throughout a relative rotational movement between the first and second connectors;

wherein the first connector includes a first casing that substantially surrounds the first electrical contact member and, wherein, the second connector includes a second casing that substantially surrounds the second electrical contact member; and wherein the at least one biasing member is electrically conductive and forms a further electrical contact member providing electrical connection between the first casing and the second casing.

2. A rotatable electrical coupling device according to claim 1, wherein the second connector is configured to be coupled to the first connector for rotation about an axis (X) relative to the first connector, whereby the first and second electrical contact members are configured to engage one another and to maintain uninterrupted electrical contact throughout a relative rotational movement between the first and second connectors.

3. A rotatable electrical coupling device according to claim 2, wherein the second connector is configured to be coupled with the first connector for essentially unimpeded rotation about an axis (X) relative to the first connector.

4. A rotatable electrical coupling device according to claim 1, wherein the second connector is configured to be received in the first casing for rotational movement relative to the first connector.

5. A rotatable electrical coupling device according to claim 1, wherein each of the first casing and the second casing is electrically conductive and forms an electrical shield around the respective first and second contact member.

6. A rotatable electrical coupling device according to claim 2, wherein the first and second electrical contact members are configured to engage one another on the rotational axis (X) of the coupling device and in an axial direction.

7. A rotatable electrical coupling device according to claim 2, wherein a part of the first contact member configured to engage with the second contact member comprises one of a male element and a female element, and a complementary part of the second contact member configured to engage with said part of the first contact member comprises the other of a male element and a female element, said parts being adapted for mating engagement and preferably being rotationally symmetrical about the rotational axis (X) for continuous surface contact with one another.

8. A rotatable electrical coupling device according to claim 1, wherein the at least one biasing member is resiliently yieldable and acts to bias the first and/or the second electrical contact member in the axial direction.

9. A rotatable electrical coupling device according to claim 1, wherein the at least one biasing member is provided on the first connector for contact or engagement with a second casing that substantially surrounds the second electrical contact member, and/or is provided on the second connector for contact or engagement with a first casing that substantially surrounds the first electrical contact member, the at least one biasing member preferably being arranged between the first casing and the second casing.

10. A rotatable electrical coupling device according to claim 1, wherein the at least one biasing member is provided on a first casing that substantially surrounds the first electrical contact member, and preferably on a retaining member of the first casing, for contact or engagement with an outer surface of a second casing that substantially surrounds the second electrical contact member.

11. A rotatable electrical coupling device according to claim 1, further comprising a retaining member configured to secure or lock the second connector against removal from a coupled state with the first connector.

12. A rotatable electrical coupling device according to claim 11, wherein the retaining member is provided on a first casing that substantially surrounds the first electrical contact member and is configured to hold the second connector against removal from the first casing;

wherein the retaining member is preferably formed as a cover or closure at an end of the first casing to substantially hold the second connector within the first casing.

13. A rotatable electrical coupling device according to claim 1, wherein the first connector includes a first adapter for releasable connection of a cable adapted for high-frequency and/or high-speed data transmission; and/or wherein the second connector includes a second adapter for releasable connection of a cable adapted for high-frequency and/or high-speed data transmission.

14. A swivel or pivot joint of a mounting arm for supporting or suspending technical equipment, wherein the joint incorporates an electrical coupling device according to claim 1.

* * * * *